US006978626B2

(12) United States Patent
Kim et al.

(10) Patent No.: US 6,978,626 B2
(45) Date of Patent: Dec. 27, 2005

(54) REFRIGERATOR AND CONTROL METHOD THEREOF

(75) Inventors: Woo Sung Kim, Gwangju (KR); Eui Young Chang, Suwon-Si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/834,365

(22) Filed: Apr. 29, 2004

(65) Prior Publication Data

US 2005/0235665 A1 Oct. 27, 2005

(30) Foreign Application Priority Data

Apr. 23, 2004 (KR) ..... 10-2004-28349

(51) Int. Cl.[7] ..... F25C 1/12

(52) U.S. Cl. ..... 62/74; 62/188; 62/347; 137/487.5

(58) Field of Search ..... 62/74, 188, 189, 62/233, 347; 137/486, 487.5

(56) References Cited

U.S. PATENT DOCUMENTS 3,059,445 A * 10/1962 Kniffin ..... 62/135
4,730,637 A * 3/1988 White ..... 137/62
5,568,825 A * 10/1996 Faulk ..... 137/624.11
5,946,924 A * 9/1999 Kim ..... 62/189
5,992,167 A * 11/1999 Hill et al. ..... 62/188
6,041,607 A * 3/2000 Kim ..... 62/188
6,574,974 B1 6/2003 Herzog et al.
2004/0007516 A1 * 1/2004 Fritze et al. ..... 210/263

* cited by examiner

*Primary Examiner*—William E. Tapolcai
(74) *Attorney, Agent, or Firm*—Staas & Halsey LLP

(57) ABSTRACT

A refrigerator for supplying a proper amount of water and a control method thereof. The refrigerator is optimally operated in ice-making and ice-separating modes based on the amount of water supplied for making ice cubes, and a control method thereof. The method includes the steps of (a) determining whether or not a proper amount of water is supplied to an ice cube tray in an earlier water supply mode; (b) maintaining the amount of the supplied water in the earlier water supply mode to the amount of the supplied water in a present water supply mode in case that the proper amount of the water is supplied to the ice cube tray in the earlier water supply mode, and resetting the amount of the supplied water in the present water supply mode by increasing the amount of the supplied water in the earlier water supply mode in case that the proper amount of the water is not supplied to the ice cube tray in the earlier water supply mode; and (c) supplying the water according to the amount of the supplied water in the present water supply mode.

24 Claims, 6 Drawing Sheets

PRIOR ART

REFRIGERATOR AND CONTROL METHOD THEREOF

CROSS-REFERENCE TO RELATED APPLICATION

This application claims the benefit of Korean Patent Application No. 2004-28349, filed Apr. 23, 2004, in the Korean Intellectual Property Office, the disclosure of which is incorporated herein by reference.

BACKGROUND OF THE INVENTION

1. Field of the Invention

The present invention relates to a refrigerator and a control method thereof, and, more particularly, to a refrigerator for properly regulating the supply mount of water for making ice cubes and a control method thereof.

2. Description of the Related Art

Generally, a refrigerator is an apparatus for freshly storing foods at a low temperature, and comprises an ice-making device disposed therein for automatically generating ice cubes.

The conventional ice-making device is disposed in a freezing chamber, and allows water to be automatically supplied into an ice cube tray and checks the ice-making state of the ice cube tray. Then, when the ice-making is completed, the ice-making device automatically separates the obtained ice cubes from the ice cube tray and puts the ice cubes into an ice cube storage container.

As shown in FIG. 1, the conventional ice-making device of the refrigerator comprises a water supply pipe 3 connected to a water supply source 1 for supplying water, a water supply valve 4 installed at a designated portion of the water supply pipe 3 for regulating the amount of water flowing along the water supply pipe 3, a rotary turbine installed between the water supply valve 4 and the water supply pipe 3 and rotated by hydraulic pressure, a purification filter 2 installed at a designated portion of the water supply pipe 3 for purifying the water along the water supply pipe 3, and an ice cube tray 6 for generating ice cubes from the water supplied from the water supply pipe 3.

When an instruction to generate ice cubes is inputted into the refrigerator, a control unit (not shown) controls the water supply valve 4 to be opened. When the water supply valve 4 is opened, the water is supplied to the ice-making device through the water supply pipe 3 connected to the water supply source 1, and passes through the purification filter 2, thus being purified. The water having passed through the purification filter 2 is supplied to the ice cube tray 6.

In a water supply mode, the control unit determines whether or not a predetermined water supply time elapses, and closes the water supply valve 4 in case that it is determined that the predetermined water supply time elapses. Thereby, the water supply mode for supplying water to ice cube tray 6 is terminated.

However, the above conventional ice-making device controls the supply of the water into the ice cube tray only for a determined time and does not consider variation in the hydraulic pressure or other aspects, thus having a difficulty of supplying a precise amount of water to the ice cube tray.

SUMMARY OF THE INVENTION

Therefore, an aspect of the invention is to provide a refrigerator, for supplying a proper amount of water, and a control method thereof.

It is another aspect of the present invention to provide a refrigerator, for optimally performing ice-making and ice-separating modes based on the amount of water for making ice cubes, and a control method thereof.

In accordance with a first aspect, the present invention provides a method for controlling a refrigerator comprising the steps of: (a) determining whether or not a proper amount of water is supplied to an ice cube tray in an earlier water supply mode; (b) maintaining the amount of the supplied water in the earlier water supply mode to the amount of the supplied water in a present water supply mode in case that the proper amount of the water is supplied to the ice cube tray in the earlier water supply mode, and resetting the amount of the supplied water in the present water supply mode by increasing the amount of the supplied water in the earlier water supply mode in case that the proper amount of the water is not supplied to the ice cube tray in the earlier water supply mode; and (c) supplying the water according to the amount of the supplied water in the present water supply mode.

In accordance with a second aspect, the present invention provides a method for controlling a refrigerator comprising the steps of: (a) determining whether or not a proper amount of water is supplied to an ice cube tray in an earlier water supply mode; (b) maintaining the frequency of the supplied water in the earlier water supply mode to the frequency of the supplied water in a present water supply mode in case that the proper amount of the water is supplied to the ice cube tray in the earlier water supply mode, and resetting the frequency of the supplied water in the present water supply mode by increasing the frequency of the supplied water in the earlier water supply mode in case that the proper amount of the water is not supplied to the ice cube tray in the earlier water supply mode; and (c) supplying the water according to the frequency of the supplied water in the present water supply mode.

In accordance with a third aspect, the present invention provides a method for controlling a refrigerator comprising the steps of: (a) determining whether or not a proper amount of water is supplied to an ice cube tray in an earlier water supply mode; (b) maintaining the water supply time of the earlier water supply mode to the water supply time of a present water supply mode in case that the proper amount of the water is supplied to the ice cube tray in the earlier water supply mode, and resetting the water supply time of the present water supply mode by increasing the water supply time of the earlier water supply mode in case that the proper amount of the water is not supplied to the ice cube tray in the earlier water supply mode; and (c) supplying the water according to the water supply time of the present water supply mode.

In accordance with a fourth aspect, the present invention provides a method for controlling a refrigerator comprising the steps of: (a) determining whether or not a proper amount of water is supplied to an ice cube tray in an earlier water supply mode; (b) differently setting an ice-separating time according to whether or not the proper amount of the water is supplied to the ice cube tray in the earlier water supply mode; and (c) performing an ice-separating mode during the set ice-separating time.

In accordance with a fifth aspect, the present invention provides a method for controlling a refrigerator comprising the steps of: (a) determining whether or not a proper amount of water is supplied to an ice cube tray in an earlier water supply mode; (b) differently setting the frequency of separating ice from the ice cube tray according to whether or not the proper amount of the water is supplied to the ice cube tray in the earlier water supply mode; and (c) performing ice-separating modes equal to the set frequency of separating the ice from the ice cube tray.

In accordance with a sixth aspect, the present invention provides a refrigerator comprising: an ice cube tray; a water supply pipe for supplying water to the ice cube tray; a water supply valve installed at a designated position for regulating the flow of the water supplied to the ice cube tray; a water supply information storing unit for storing information regarding the water supply; and a control unit for resetting the amount of the supplied water in a present water supply mode by increasing the amount of the supplied water in an earlier water supply mode in case that the proper amount of the water is not supplied to the ice cube tray in the earlier water supply mode.

BRIEF DESCRIPTION OF THE DRAWINGS

The above aspects, and other features and advantages of the present invention will become more apparent after reading the following detailed description when taken in conjunction with the drawings, in which.

DETAILED DESCRIPTION OF THE PREFERRED EMBODIMENTS

Figure 1:
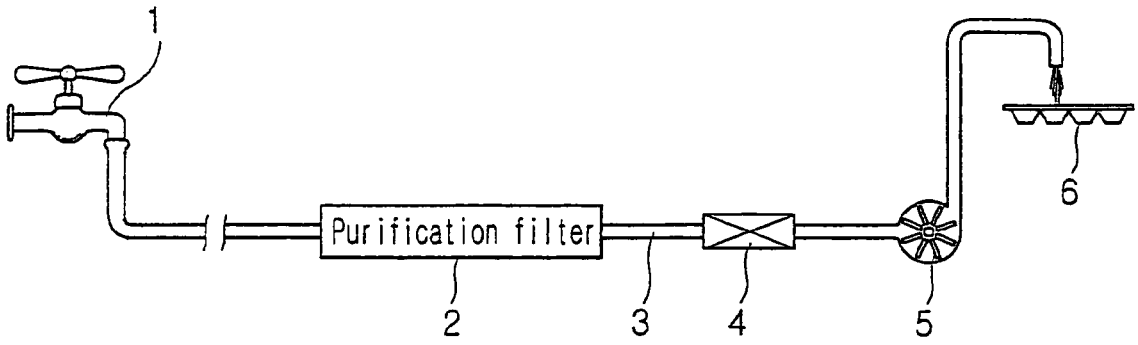
FIG. 1 is a schematic view illustrating a water supply unit of a conventional refrigerator.
Figure 2:
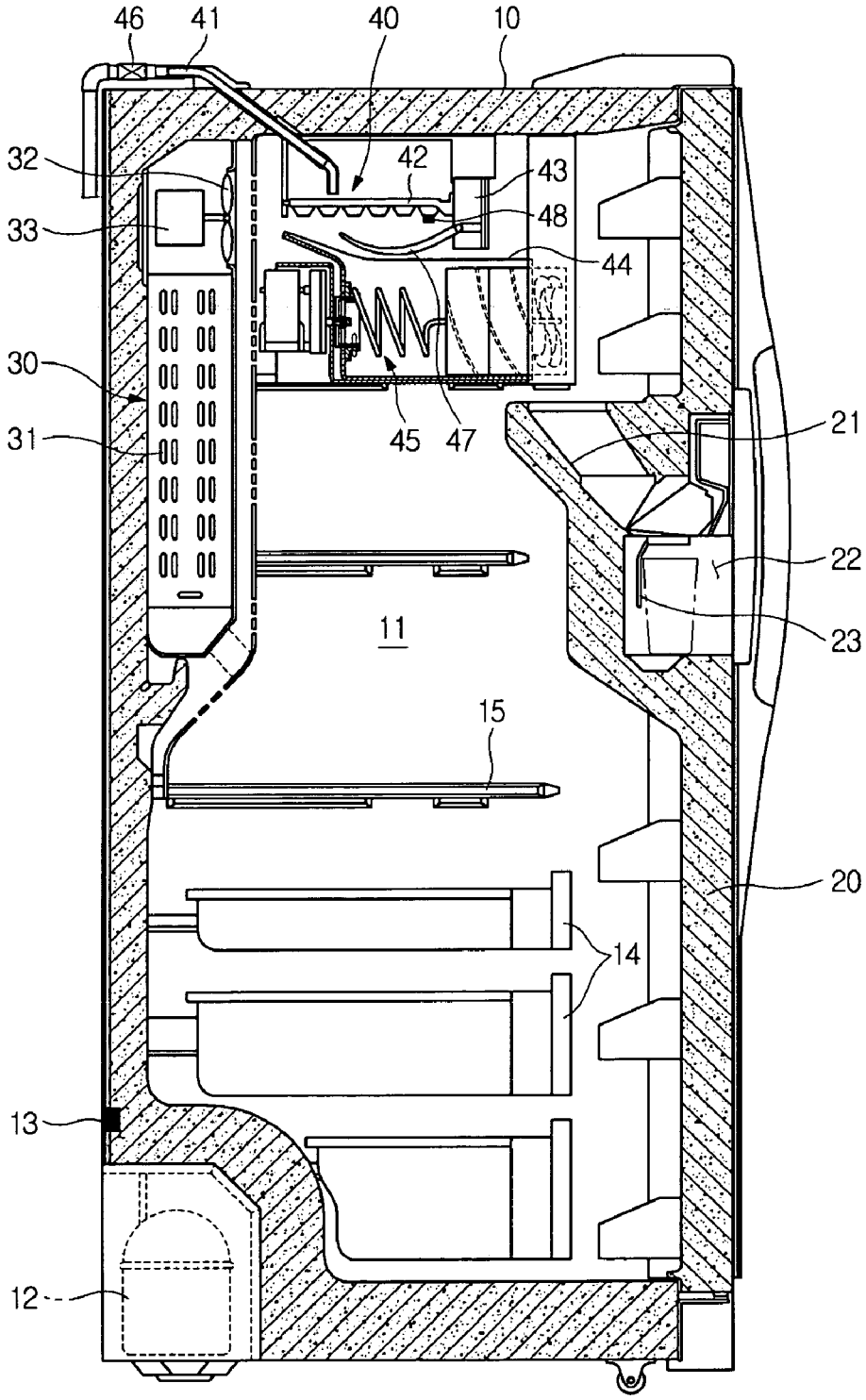
FIG. 2 is a longitudinal-sectional view of a refrigerator in accordance with an embodiment of the present invention.

Now, a preferred embodiment of the present invention will be described in detail with reference to the annexed drawings. As shown in FIG. 2, the refrigerator in accordance with the preferred embodiment of the present invention comprises a freezing chamber 11 disposed in a main body 10 in a lengthwise direction and provided with an opened front surface, a freezing chamber door 20 positioned at the opened front surface for opening and closing the freezing chamber 11, and a compressor 12 installed at a lower part of a rear surface of the main body 10 for compressing a refrigerant. Further, a plurality of racks 15 and storage boxes 14 for storing foods are aligned in the freezing chamber 11. An outdoor temperature sensor 13 for sensing outdoor temperature is installed at a designated position of the rear surface of the main body 10.

A heat exchanging unit 30 for achieving the heat-exchange is installed between the rear surface of an upper part of the freezing chamber 11 and the main body 10, and an ice-making unit 40 for automatically making ice cubes is installed at the upper part of the freezing chamber 11.

The heat exchanging unit 30 includes a heat exchanger 31 for cooling air in the freezing chamber 11 by means of heat-exchanging, a freezing chamber fan 32 installed above the freezing chamber heat exchanger 31 for circulating the cooled air having passed through the freezing chamber heat exchanger 31 into the freezing chamber 11, and a fan motor 33 for operating the freezing chamber fan 32.

The ice-making unit 40 includes a water supply pipe 41 for supplying water for making ice cubes, an ice cube tray 42 provided with a plurality of ice making grooves, an ice-separating unit 43 for rotating the ice cube tray 42 for separating the ice cubes from the ice cube tray 42, and a full ice level lever 47 installed at a side portion of the ice-separating unit 43 for sensing the quantity of the ice cubes stored in an ice storage container 44, which will be described later. An ice-making sensor 48 for measuring the ice cube tray 42 is attached to the lower surface of the ice cube tray 42. The ice storage container 44, for storing the ice cubes separated from the ice cube tray 42, and a transferring unit 45, for automatically transferring the ice cubes stored by the ice storage container 44 to the outside of the freezing chamber 11, are installed below the ice cube tray 42.

The water supply pipe 41 is provided with one end extended toward the upper part of the ice cube tray 42 so that the water is stably supplied from the water supply pipe 41 to the ice cube tray 42, and a water supply valve 46 for regulating the flow of the water supplied to the ice cube tray 42 is installed at a designated position of the water supply pipe 41.

A discharge guide pipe 21, communicating with the inside of the freezing chamber 11 for guiding the discharge of the ice cubes so that the ice cubes stored by the ice storage container 44 are drawn out without a user having to open the freezing chamber door 20, is installed in the freezing chamber door 20, and an ice receiving space 22 for receiving the ice cubes discharged through the discharge guide pipe 21 is indented in the front surface of the freezing chamber door 20. A switch 23 for opening and closing an outlet of the discharge guide pipe 21 and operating the transferring unit 45 is installed in the ice receiving space 22.

Figure 3:
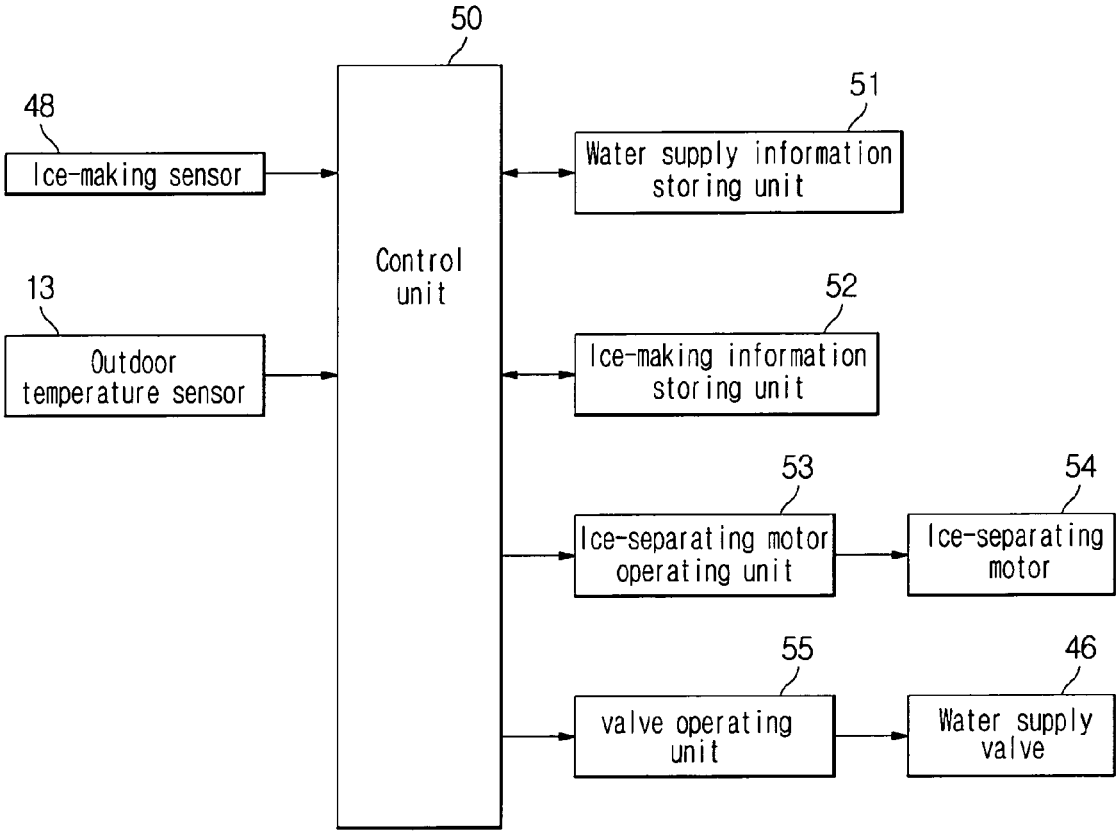
FIG. 3 is a block diagram illustrating constitution of the refrigerator shown in FIG. 2.

As shown in FIG. 3, the refrigerator as shown in FIG. 2 in accordance with the embodiment of the present invention further comprises an ice-separating motor 54, an ice-separating motor operating unit 53 for operating the ice-separating motor 54, a valve operating unit 55 for operating the water supply valve 46, a water supply information storing unit 51 for storing water supply information, an ice-making information storing unit 52 for storing ice-separating information, and a control unit 50 for controlling the overall operation of the refrigerator.

The water supply information includes a total water supply frequency, recognition of the water supply, and a water supply time corresponding to each water supply frequency, in the earlier water supply mode. The total water supply frequency in the earlier water supply mode denotes a total frequency of water supply performed in the water supply mode prior to the present water supply mode. For example, in case that the earlier water supply mode is operated such that water supply is performed twice and ice-making, ice-separating and water supply modes are sequentially operated, the total water supply frequency in the earlier water supply mode is two.

In case that the present water supply mode is initially operated and the total water supply frequency of the earlier water supply mode is not stored, the total water supply frequency is set to one. Whenever the total water supply frequency is changed, the control unit 50 stores the changed frequency in the water supply information storing unit 51. The stored frequency is used as the total water supply mode of the earlier water supply mode.

Whether or not the water supply is recognized determined by whether or not variation in temperature of the ice-making sensor 48 before and after the water supply is more than a designated value. That is, in case that the variation in temperature of the ice-making sensor 48 before and after the water supply is less than the designated value, it is determined that the water supply is not recognized due to the supply of less than the proper amount of the water, and in case that the variation in temperature of the ice-making sensor 48 before and after the water supply is more than the designated value, it is determined that the water supply is recognized due to the completion of the supply of the proper amount of the water. Generally, in case that the amount of supplied water for a predetermined time is less than the proper amount so that the ascent range of the temperature measured by the ice-making sensor 48 after the water supply is not high, or ice cubes are not completely separated from the ice cube tray and remain in the ice cube tray in the earlier ice-making mode so that the ascent range of the temperature measured by the ice-making sensor 48 in spite of the water supply, it is determined that the water supply is not recognized.

The water supply time corresponding to each water supply frequency is predetermined, and is then stored based on Table 1 below. The water supply times according to the water supply frequencies are set to proper values by experimentation.

TABLE 1

| | Water Supply Frequency | | | |
|---|---|---|---|---|
| | 1 | 2 | 3 | 4 |
| Water Supply Time | 5 sec. | 2 sec. | 2 sec. | 1 sec. |

The ice-making information storing unit 52 stores information regarding ice-making time. The ice-making time is differently set based on whether or not the water supply is recognized in the water supply mode, the water supply frequency and the outdoor temperature, and is stored based on Table 2 below.

TABLE 2

| | Recognition of water supply | | Non-recognition of water supply | |
|---|---|---|---|---|
| Water Supply Freq. | Outdoor temp. of less than 17° C. | Outdoor temp. of more than 18° C. | Outdoor temp. of less than 17° C. | Outdoor temp. of more than 18° C. |
| 1 | 65(58 + 7) min. | 58 min. | 110 min. | 95 min. |
| 2~4 | 58 min. | 58 min. | 70 min. | 70 min. |

As stated in Table 2, the ice-making time when the water supply is not recognized is set to be longer than the ice-making time when the water supply is recognized. In case that the water supply is not recognized due to low water pressure, the ice cube tray is not fully filled with water such that the water does not reach the ice making groove where the ice-making sensor is positioned. In this case, since the specific heat around the ice making groove where the ice-making sensor is positioned is smaller than the specific heat of the water, variation in the temperature of the ice making groove where the ice-making sensor is positioned is higher than that of the ice-making grooves filled with the water.

Accordingly, in case that the ice-making mode is operated under the condition that the water supply is not recognized, the temperature of the ice-making sensor descends sufficiently lower than the temperature of ice-making termination so as to satisfy the ice-making completion conditions. However, since the ice making grooves except for the ice making groove where the ice-making sensor is positioned is comparatively high, it is difficult to produce the ice cubes in the ice making grooves. By lengthening the ice-making time when the water supply is not recognized to be longer than the ice-making time when the water supply is recognized, it is possible to produce the ice cubes in the ice making grooves except for the ice making groove where the ice-making sensor is positioned.

Further, in case that the outdoor temperature is low, the ice-making time is set to be comparatively long. When the outdoor temperature is low, the operating rate of the compressor is low, thus delaying the ice-making speed.

Moreover, since the water pressure when the water supply frequency is once is higher than the water pressure when the water supply frequency is 2 or more, the amount of the water supply when the water supply frequency is once is greater than the amount of the water supply when the water supply frequency is 2 or more. Accordingly, the ice-making time when the water supply frequency is once is set to be longer than the ice-making time when the water supply frequency is 2 or more.

Figure 4:
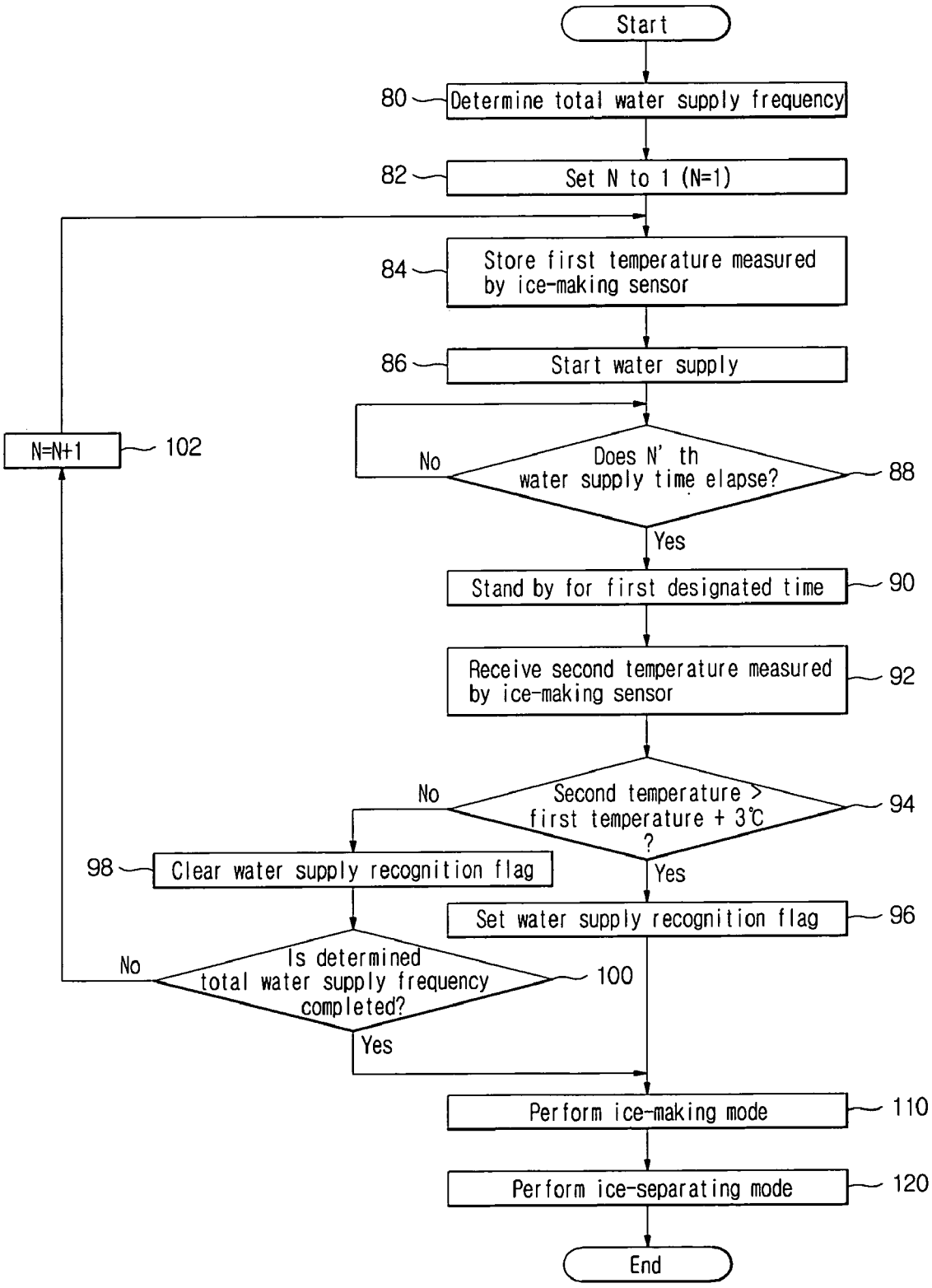
FIG. 4 is a flow chart illustrating operation of the refrigerator shown in FIG. 3.

Hereinafter, with reference to FIG. 4, operation of the refrigerator shown in FIG. 3 will be described in detail. In case that it is determined that the ice-making mode will be operated based on ice-making instructions from a user or self-determination of the control unit 50, the control unit 50 determines the total water supply frequency in the water supply mode (S80).

Thereafter, the control unit 50 sets the total water supply frequency N (N is a natural number) to 1 (S82), and stores a first temperature measured by the ice-making sensor 48 (S84). When the first temperature is inputted into the control unit 50, the control unit 50 opens the water supply valve 46 and starts the water supply (S86). During the water supply, the control unit 50 determines whether or not the water supply time corresponding to the total water supply frequency of N is terminated (S88). The water supply time corresponding to the total water supply frequency of N is obtained from Table 1 stored by the water supply information storing unit 51.

In case that the water supply time corresponding to the total water supply frequency of N is not terminated, the process flow is returned to step S88, and in case that the water supply time corresponding to the total water supply frequency of N is terminated, the control unit 50 stands by for a first designated time (S90). The first designated time is a time taken to sufficiently sense variation in temperature by the water supplied from the ice-making sensor 48 after the water supply, and a proper value of the first designated time is selected by experimentation. In the preferred embodiment of the present invention, the first designated time is set to approximately 1 minute 30 seconds.

After the first designated time elapses, a second temperature measured by the ice-making sensor 48 is inputted to the control unit 50 (S92). When the second temperature is inputted to the control unit 50, the control unit 50 determines whether or not the second temperature is higher than the first temperature by 3C or more (S94).

In case that it is determined that the second temperature is higher than the first temperature by 3° C. or more, the control unit 50 sets a water supply recognition flag (S96), and operates an ice-making mode irregardless of the residual water supply frequency (S110). For example, in case that the total water supply frequency set in step S80 is 3 and the second temperature in the first water supply mode is higher than the first temperature by 3° C. or more, the second or third supply mode is not operated but the ice-making mode is operated.

However, in case that the second temperature is not higher than the first temperature by 3° C. or more, since it is determined that the amount of the water supply is smaller than the proper amount, the control unit 50 clears the water supply recognition flag (That is, it is determined that the water supply is not recognized) (S98). The control unit 50 stores the information, regarding whether or not the water supply is recognized, to the water supply information storing unit 51 so that the stored information is referred to during the next water supply mode.

When the water supply is not recognized, the control unit 50 determines whether or not the water supply having the frequency set in step S60 is completed (S100). In case that the total frequency of the water supply is not completed, the control unit 50 increases the frequency (N) by 1, i.e., N=N+1 (S102), and operates the residual frequency of the water supply, and in case that the total frequency of the water supply is completed, the control unit 50 performs the ice-making and ice-separating modes sequentially (S110 and S120).

Figure 5:
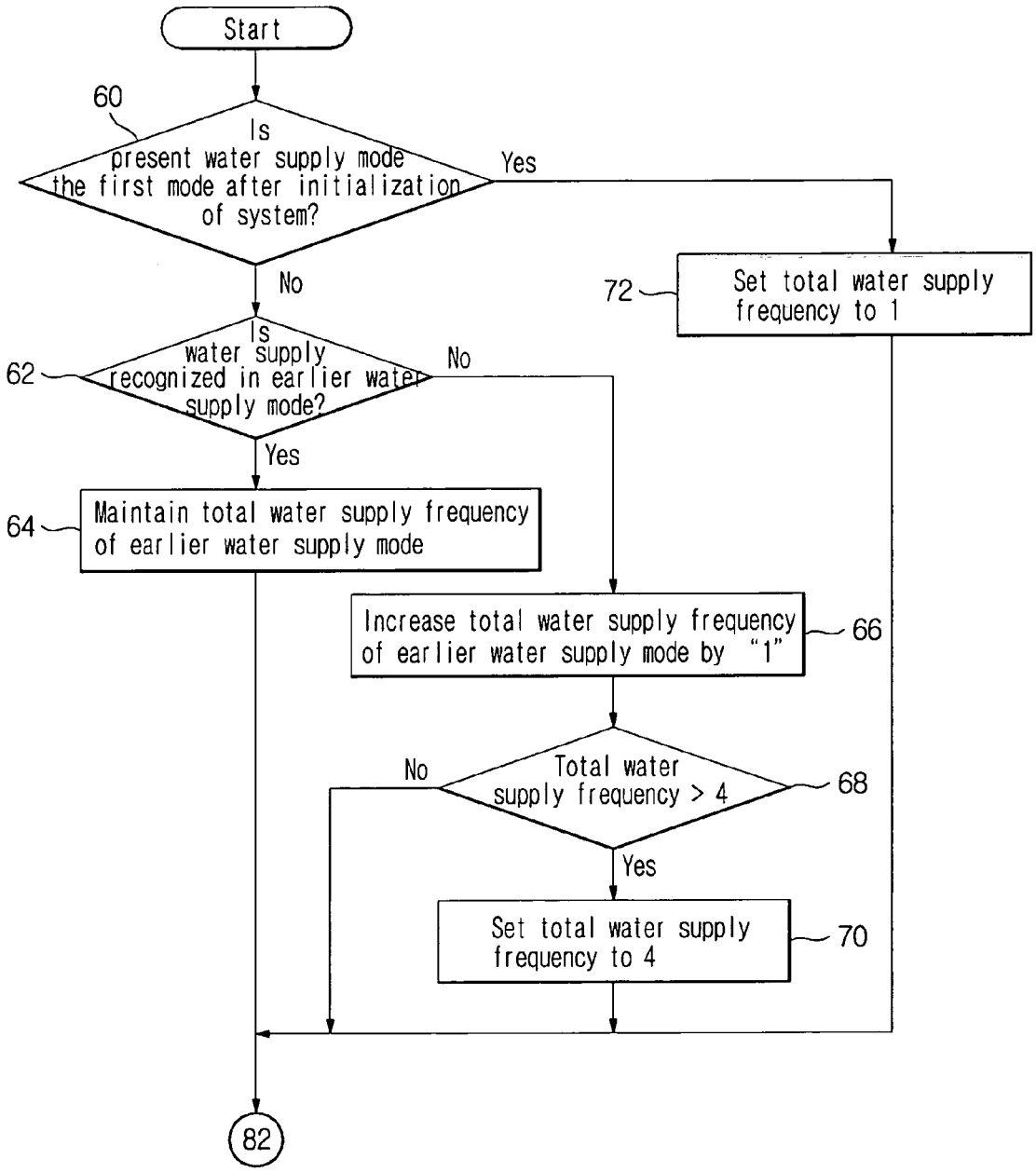
FIG. 5 is a flow chart illustrating operation for setting the frequency of water supply in FIG. 4.

Hereinafter, with reference to FIG. 5, a process for determining the total water supply frequency shown in FIG. 4 will be described in detail. In order to determine the total water supply frequency, the control unit 50 determines whether or not the present water supply is the first one after the initialization of the system (S60). In case that the present water supply is the first one after the initialization of the system, the control unit 50 sets the total water supply frequency to "1" (S72), and in case that the present water supply is not the first one after the initialization of the system, the control unit 50 determines whether or not the water supply of the earlier water supply mode is recognized (S62). Whether or not the water supply of the earlier water supply mode is recognized is determined by the water supply recognition information stored in the water supply information storing unit 51.

In case that the water supply of the earlier water supply mode is recognized, the total water supply frequency in the earlier water supply mode is set to the water supply frequency in the present water supply mode (S64). However, in case that the water supply of the earlier water supply mode is not recognized, it is determined that the water of less than the proper amount is supplied to the ice cube tray 42 in the earlier water supply mode, and the control unit 50 adds "1" to the water supply frequency of the earlier water supply mode, thus applying the obtained value to the total water supply frequency in the present water supply mode (S66). In this case, the water supply amount and the water supply time of the present water supply mode increase compared to those in the earlier water supply mode.

Thereafter, the control unit 50 determines whether or not the total water supply frequency in the present water supply mode exceeds "4" (S68). In case that the total water supply frequency in the present water supply mode exceeds "4", the control unit 50 restricts the total water supply frequency to "4" (S70), and in case that the total water supply frequency in the present water supply mode does not exceed "4", the control unit 50 sets the water supply frequency in the present water supply mode to a value obtained by adding one to the water supply frequency in the earlier water supply mode. By restricting the upper limit of the total water supply frequency, it is possible to prevent the total water supply frequency from indefinitely increasing.

Figure 6:
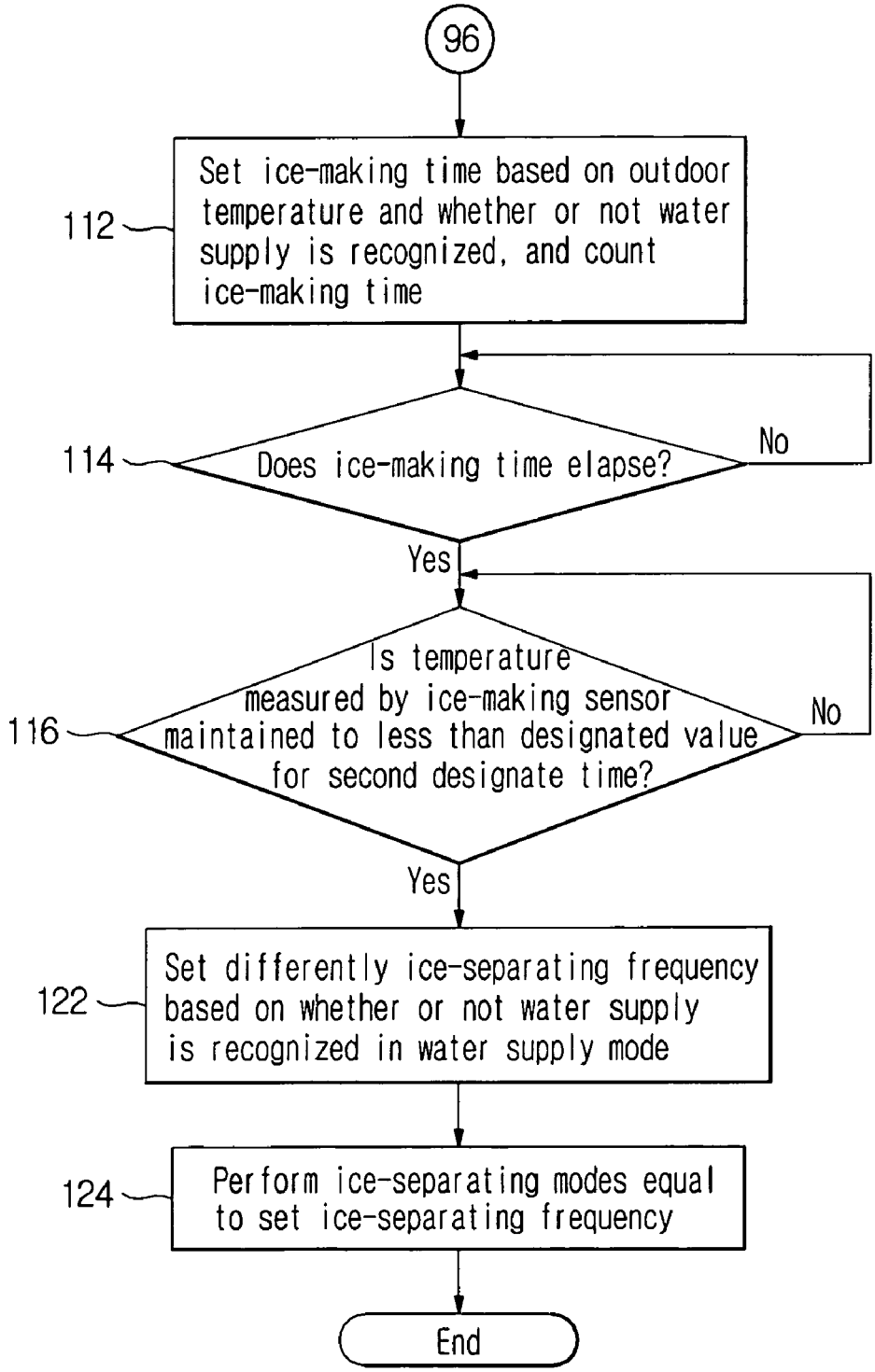
FIG. 6 is a flow chart illustrating ice-making and ice-separating modes in FIG. 4.

Hereinafter, with reference to FIG. 6, a process for operating the ice-making and ice-separating modes shown in FIG. 4 will be described in detail. When the water supply is completed in the water supply mode, the control unit 50 receives a value measured by the outdoor temperature sensor 13, determines an ice-making time with reference to the water supply recognition information and the total water supply frequency stored by the water supply information storing unit 51 and Table 2, and then counts the ice-making time (S112).

The control unit 50 counts the ice-making time, and determines whether or not the set ice-making time is completed (S114). In case that the set ice-making time is not completed, the process is returned to step S114, and in case that the set ice-making time is completed, the control unit 50 determines whether or not the temperature measured by the ice-making sensor 48 is maintained below a designated temperature for a second designated time (S116).

The determination of the temperature measured by the ice-making sensor 48 is performed in order to check whether or not ice cubes are fully made after the ice-making time elapses. Here, the designated temperature and the second designated time are properly set by experimentation. In the preferred embodiment of the present invention, in case that the temperature measured by the ice-making sensor 48 is maintained below −17° C. for approximately 5 minutes or more after the ice-making time elapses, it is determined that the ice-making is fully achieved.

In case that the temperature measured by the ice-making sensor 48 is not maintained below −17° C. for approximately 5 minutes or more after the ice-making time elapses, it is determined that the ice-making is not fully achieved and the process is returned to the earlier step, and in case that the temperature measured by the ice-making sensor 48 is maintained below −17° C. for approximately 5 minutes or more after the ice-making time elapses, the control unit 50 terminates the ice-making mode and operates the ice-separating mode.

The control unit 50 differently sets an ice-separating frequency, based on whether or not the water supply in the water supply mode is recognized, with reference to the water supply recognition information of the water supply information storing unit 51 (S122). For example, in case that the water supply in the water supply mode is recognized, the control unit 50 sets the ice-separating frequency to "1", and in case that the water supply in the water supply mode is not recognized, the control unit 50 sets the ice-separating frequency to "2".

The ice-separating frequency when the water supply it not recognized is larger than the ice-separating frequency when the water supply is recognized, in order to fully separate ice cubes from the ice cube tray in case that it is determined that the water supply is not recognized due to the incomplete separation of the ice cubes in the ice-separating mode.

When the ice-separating frequency is set, the control unit 50 rotates the ice-separating motor 54, thereby operating the ice-separating mode.

As apparent from the above description, the present invention provides a refrigerator and a method for controlling the same, in which a proper amount of water for making ice cubes is supplied.

Further, in accordance with the present invention, it is possible to optimally operate ice-making and ice-separating modes based on the amount of the supplied water.

Although the preferred embodiment of the invention has been disclosed for illustrative purposes, those skilled in the art will appreciate that various modifications, additions and substitutions are possible, without departing from the scope and spirit of the invention as disclosed in the accompanying claims.

What is claimed is:

1. A method for controlling a refrigerator comprising the steps of:

(a) determining whether or not a proper amount of water is supplied to an ice cube tray in an earlier water supply mode;

(b) maintaining the amount of the supplied water in the earlier water supply mode to the amount of the supplied water in a present water supply mode in case that the proper amount of the water is supplied to the ice cube tray in the earlier water supply mode, and resetting the amount of the supplied water in the present water supply mode by increasing the amount of the supplied water in the earlier water supply mode in case that the proper amount of the water is not supplied to the ice cube tray in the earlier water supply mode; and (c) supplying the water according to the amount of the supplied water in the present water supply mode.

2. The method according to claim 1, wherein the supplied water is less than the proper amount in case that the proper amount of the water is not supplied to the ice cube tray in the earlier water supply mode, and the increase of the amount of the supplied water increases a predetermined water supply frequency.

3. The method according to claim 2, wherein whether or not the supplied water is less than the proper amount is determined by whether or not the water supply is recognized in the water supply mode.

4. The method according to claim 3, wherein whether or not the water supply is recognized in the water supply mode is determined by whether or not a difference between temperatures of the ice cube tray at the starting of each water supply and after a designated time from the starting of the water supply is larger than a predetermined value.

5. The method according to claim 2, wherein the water supply frequency is at least one, and the water supply time of each water supply frequency is differently set.

6. The method according to claim 5, wherein the water supply frequency is set to be less than a designated value.

7. A method for controlling a refrigerator comprising the steps of:

(a) determining whether or not a proper amount of water is supplied to an ice cube tray in an earlier water supply mode;

(b) maintaining the frequency of the supplied water in the earlier water supply mode to the frequency of the supplied water in a present water supply mode in case that the proper amount of the water is supplied to the ice cube tray in the earlier water supply mode, and resetting the frequency of the supplied water in the present water supply mode by increasing the frequency of the supplied water in the earlier water supply mode in case that the proper amount of the water is not supplied to the ice cube tray in the earlier water supply mode; and (c) supplying the water according to the frequency of the supplied water in the present water supply mode.

8. The method according to claim 7, wherein whether or not the proper amount of the water is supplied to the ice cube tray is determined by whether or not the water supply is recognized in the water supply mode.

9. The method according to claim 8, wherein it is determined that the proper amount of the water is not supplied to the ice cube tray in case that the water supply is not recognized in the water supply mode.

10. The method according to claim 8, wherein whether or not the water supply is recognized in the water supply mode is determined by whether or not a difference between temperatures of the ice cube tray at the starting of each water supply and after a designated time from the starting of the water supply is larger than a predetermined value.

11. The method according to claim 7, wherein:

it is determined whether or not the water supply is recognized in each water supply; and the water supply mode is terminated, in case that the water supply is recognized, although all of the water supply frequency is not completed.

12. A method for controlling a refrigerator comprising the steps of:

(a) determining whether or not a proper amount of water is supplied to an ice cube tray in an earlier water supply mode;

(b) maintaining the water supply time of the earlier water supply mode to the water supply time of a present water supply mode in case that the proper amount of the water is supplied to the ice cube tray in the earlier water supply mode, and resetting the water supply time of the present water supply mode by increasing the water supply time of the earlier water supply mode in case that the proper amount of the water is not supplied to the ice cube tray in the earlier water supply mode; and (c) supplying the water according to the water supply time of the present water supply mode.

13. A method for controlling a refrigerator comprising the steps of:

(a) determining whether or not a proper amount of water is supplied to an ice cube tray in an earlier water supply mode;

(b) differently setting an ice-making time according to whether or not the proper amount of the water is supplied to the ice cube tray in the earlier water supply mode; and (c) performing an ice-making mode during the set ice-making time.

14. The method according to claim 13, wherein whether or not the proper amount of the water is supplied to the ice cube tray is determined by whether or not the water supply is recognized in the water supply mode.

15. The method according to claim 14, wherein it is determined that the proper amount of the water is not supplied to the ice cube tray in case that the water supply is not recognized in the water supply mode.

16. The method according to claim 14, wherein the ice-separating time is differently set according to whether or not the water supply is recognized and the outdoor temperature.

17. The method according to claim 14, wherein the ice-separating time is differently set according to whether or not the water supply is recognized and the frequency of the water supply mode.

18. A method for controlling a refrigerator comprising the steps of:

(a) determining whether or not a proper amount of water is supplied to an ice cube tray in an earlier water supply mode;

(b) differently setting the frequency of separating ice from the ice cube tray according to whether or not the proper amount of the water is supplied to the ice cube tray in the earlier water supply mode; and (c) performing ice-separating modes equal to the set frequency of separating the ice from the ice cube tray.

19. The method according to claim 18, whether or not the proper amount of the water is supplied to the ice cube tray is determined by whether or not the water supply is recognized in the water supply mode.

20. The method according to claim 19, wherein it is determined that the proper amount of the water is not supplied to the ice cube tray in case that the water supply is not recognized in the water supply mode.

21. The method according to claim 19, wherein the frequency of separating the ice from the ice cube tray in case that the water supply is not recognized is set to be larger than the frequency of separating the ice from the ice cube tray in case that the water supply is recognized.

22. A refrigerator comprising:

an ice cube tray;

a water supply pipe for supplying water to the ice cube tray;

a water supply valve installed at a designated position for regulating the flow of the water supplied to the ice cube tray;

a water supply information storing unit for storing information regarding the water supply; and a control unit for resetting the amount of the supplied water in a present water supply mode by increasing the amount of the supplied water in an earlier water supply mode in case that the proper amount of the water is not supplied to the ice cube tray in the earlier water supply mode.

23. The refrigerator according to claim 22, wherein the water supply information storing unit includes information regarding a water supply frequency in the water supply mode, whether or not the water supply is recognized, and a water supply time according to the water supply frequency.

24. The refrigerator according to claim 22, wherein the supplied water is less than the proper amount in case that the proper amount of the water is not supplied to the ice cube tray in the earlier water supply mode, and the increase of the amount of the supplied water increases a predetermined water supply frequency.

* * * * *